US006859145B2

(12) United States Patent
Wilker et al.

(10) Patent No.: US 6,859,145 B2
(45) Date of Patent: Feb. 22, 2005

(54) SAFETY SYSTEM

(76) Inventors: Scott Wilker, 139 Central Ave., Glen Rock, NJ (US) 07452; Judith Bergner, 29 Arrowwood Cir., Rye Brook, NY (US) 10573; Kenneth R. Altberg, 2 Crestwood Dr., Danbury, CT (US) 06811; Ronald S. Hollister, 6A Hobson St., Danbury, CT (US) 06810

( * ) Notice: Subject to any disclaimer, the term of this patent is extended or adjusted under 35 U.S.C. 154(b) by 0 days.

(21) Appl. No.: 10/405,255

(22) Filed: Apr. 3, 2003

(65) Prior Publication Data

US 2004/0196155 A1 Oct. 7, 2004

(51) Int. Cl.[7] ..... G08B 23/00

(52) U.S. Cl. ..... 340/693.5; 340/539.14; 340/542; 340/545.1; 340/545.7; 340/545.8; 340/691.1

(58) Field of Search ..... 340/693.5–693.12, 340/691.1, 692, 691.6, 584, 628, 539.1, 539.14, 542, 545.1, 546, 545.7, 550, 545.8

(56) References Cited

U.S. PATENT DOCUMENTS

| | | | | | |
|---|---|---|---|---|---|
| 4,074,225 | A | * | 2/1978 | Vandeweghe | 340/628 |
| 4,422,069 | A | | 12/1983 | Edström | 340/691 |
| 4,453,222 | A | * | 6/1984 | Goszyk | 340/628 X |
| 4,531,114 | A | * | 7/1985 | Topol et al. | 340/531 X |
| 4,707,338 | A | * | 11/1987 | Spector | 422/124 |
| 4,794,373 | A | | 12/1988 | Harrison | 340/286 R |
| 4,837,560 | A | * | 6/1989 | Newberry | 340/628 |
| 4,862,141 | A | * | 8/1989 | Jordal | 340/545.1 |
| 5,252,030 | A | * | 10/1993 | Chikada | 417/12 |
| 5,272,602 | A | | 12/1993 | Sasajima et al. | 362/80.1 |
| 5,297,011 | A | * | 3/1994 | Triunfol | 362/147 |
| 5,363,976 | A | * | 11/1994 | Kapka | 220/3.8 |
| 5,404,279 | A | | 4/1995 | Wood | 362/145 |
| 5,410,299 | A | * | 4/1995 | Hard | 340/628 |
| 5,446,439 | A | | 8/1995 | Kramer et al. | 340/326 |
| 5,446,440 | A | | 8/1995 | Gleason et al. | 340/331 |
| 5,473,517 | A | | 12/1995 | Blackman | 362/95 |
| 5,499,171 | A | | 3/1996 | Simpson et al. | 362/100 |
| 5,517,176 | A | * | 5/1996 | Lavelle et al. | 340/542 |
| 5,594,410 | A | | 1/1997 | Lucas et al. | 340/332 |
| 5,823,655 | A | | 10/1998 | Brooks | 362/145 |
| 5,825,280 | A | | 10/1998 | Merendini et al. | 340/326 |

(List continued on next page.)

FOREIGN PATENT DOCUMENTS

| | | |
|---|---|---|
| EP | 0 209 269 A2 | 1/1987 |
| JP | 2002-133968 | 5/2002 |
| WO | WO 83/03737 | 10/1983 |
| WO | WO 01/73733 A1 | 10/2001 |

*Primary Examiner*—Thomas Mullen
(74) *Attorney, Agent, or Firm*—Richard C. Litman

(57) ABSTRACT

A safety system that is configured to enhance the ability of individuals to identify points of egress in the case of actual fires or emergency situations. The safety system may include a power source, memory, a central processing unit (CPU), sensor(s), audible indicator(s), light source(s), switch(es), camera(s), a transceiver, a microphone, impact tool(s), and aromatic element(s). The power source may be any suitable AC or DC power source. The memory, CPU, audible indicator(s), light source(s), switch(es), camera(s), transceiver, microphone, impact tool(s), and aromatic element(s) may be any types well known in the art. The safety system may also include a modem configured to wirelessly or non-wirelessly transfer data to/from the safety system.

27 Claims, 3 Drawing Sheets

U.S. PATENT DOCUMENTS

| | | | | | |
|---|---|---|---|---|---|
| 5,833,350 | A | | 11/1998 | Moreland | 362/95 |
| 6,000,807 | A | | 12/1999 | Moreland | 362/95 |
| 6,058,635 | A | | 5/2000 | Morris | 40/570 |
| 6,150,943 | A | * | 11/2000 | Lehman et al. | 340/628 |
| 6,222,455 | B1 | * | 4/2001 | Kaiser | 340/628 |
| 6,249,221 | B1 | * | 6/2001 | Reed | 340/691.6 |
| D446,438 | S | | 8/2001 | Ciaramitaro et al. | D8/301 |
| 6,278,366 | B1 | * | 8/2001 | Fletcher et al. | 340/542 |
| 6,371,637 | B1 | | 4/2002 | Atchinson et al. | 362/555 |
| 6,439,732 | B1 | | 8/2002 | Weisbach | 362/100 |
| 6,454,324 | B1 | | 9/2002 | Lewis et al. | 292/341.16 |
| 6,557,611 | B1 | * | 5/2003 | Fuentes | 340/545.8 |
| 2002/0080027 | A1 | | 6/2002 | Conley, III | 340/540 |
| 2002/0084890 | A1 | | 7/2002 | Guerrieri et al. | 340/332 |
| 2002/0126498 | A1 | | 9/2002 | Atkinson et al. | 362/501 |
| 2002/0145514 | A1 | * | 10/2002 | Dawson | 340/506 |
| 2002/0149491 | A1 | * | 10/2002 | Crandall, Jr. et al. | 340/691.1 |
| 2002/0152686 | A1 | | 10/2002 | Whitehead | 49/475.1 |

* cited by examiner

SAFETY SYSTEM

BACKGROUND OF THE INVENTION

1. Field of the Invention

The present invention relates to safety systems for enhancing abilities for protecting individuals in the event of unforseen circumstances, such as fires, robberies, catastrophes, etc.

2. Description of the Related Art

Safety systems are well known in the art. For example, fire safety systems that employ smoke detectors have been widely used in closed structures such as houses, factories, shops, ships, aircraft, and the like, for many years. Smoke detectors are normally mounted in the ceiling in a passageway, hall, stairway, or the like, in a location where there is at least partial air flow, so that if a fire does occur, smoke will be monitored by the smoke detector, and a signal given. Most of these smoke detectors have a horn or buzzer which emits a high decibel sound when smoke is detected. One of the problems with these types of safety systems is that they provide no assistance in the form of establishing points of egress in the case of actual fires or emergencies, nor do they visually mark the way to safety. Emergency service personnel such as firefighters, policeman, etc., are often confronted with unpredictable situations, such as residential and commercial fires, elevator emergencies, car fires, lockouts, vehicle extrication's, etc.

The related art is represented by the following references of interest.

U.S. Design Pat. No. D446,438 S, issued on Aug. 14, 2001 to Michael A. Ciaramitaro et al., shows an ornamental design for an illuminated door handle. The Ciaramitaro et al. application does not suggest a safety system according to the claimed invention.

U.S. Patent Application Publication No. 2002/0080027 A1, published on Jun. 27, 2002 for William H. Conley, III, describes an emergency lighting remote monitoring and control system that controls and monitors the emergency lights in a building. The Conley, III application does not suggest a safety system according to the claimed invention.

U.S. Patent Application Publication No. 2002/0084890 A1, published on Jul. 4, 2002 to Salvatore Guerrieri et al., describes an illumination device. The Guerrieri et al. application does not suggest a safety system according to the claimed invention.

U.S. Patent Application Publication No. 2002/0126498 A1, published on Sep. 12, 2002 to Arthur W. Atkinson et al., describes a lighted vehicle body opening weather strip. The Atkinson et al. application does not suggest a safety system according to the claimed invention.

U.S. Patent Application Publication No. 2002/0152686 A1, published on Oct. 24, 2002 to William Whitehead, describes an illuminating weatherseal for sealing an interface between confronting surfaces and illuminating the adjacent environment. The Whitehead patent does not suggest a safety system according to the claimed invention.

U.S. Pat. No. 4,422,069, issued on Dec. 20, 1983 to Karl L. Edström et al., describes flashable lights positioned near an exit door that are actuated in case of an emergency. The Edström et al. patent does not suggest a safety system according to the claimed invention.

U.S. Pat. No. 4,794,373, issued on Dec. 27, 1988 to John M. Harrison, describes an apparatus for visually guiding the occupants of a structure in a path of travel along the floor.

The Harrison patent does not suggest a safety system according to the claimed invention.

U.S. Pat. No. 5,272,602, issued on Dec. 21, 1993 to Tetsuo Sasajima et al., describes a pair of conductive patterns that are formed on the interior surface of the rear windowpane of a vehicle. The Sasajima et al. patent does not suggest a safety system according to the claimed invention.

U.S. Pat. No. 5,404,279, issued on Apr. 4, 1995 to Johnny L. Wood, describes a permanent lighting trim assembly which permits lights to be displayed during an appropriate season. The Wood patent does not suggest a safety system according to the claimed invention.

U.S. Pat. No. 5,446,439, issued on Aug. 30, 1995 to Aug. 29, 1995 to John C. Kramer et al., describes an emergency lighting controller. The Kramer et al. patent does not suggest a safety system according to the claimed invention.

U.S. Pat. No. 5,446,440, issued on Aug. 29, 1995 to Cornel T. Gleason et al., describes materials handling devices. The Gleason et al. patent does not suggest a safety system according to the claimed invention.

U.S. Pat. No. 5,473,517, issued on Dec. 5, 1995 to Stephen E. Blackman, describes a housing for an emergency light source. The Blackman patent does not suggest a safety system according to the claimed invention.

U.S. Pat. No. 5,499,171, issued on Mar. 12, 1996 to Dixie L. Simpson et al., describes a door lock illumination apparatus. The Simpson et al. patent does not suggest a safety system according to the claimed invention.

U.S. Pat. No. 5,594,410, issued on Jan. 14, 1997 to Michael Lucas et al., describes an enhanced emergency warning and escape system. The Lucas et al. patent does not suggest a safety system according to the claimed invention.

U.S. Pat. No. 5,823,655, issued on Oct. 20, 1998 to I. Morris Brooks, describes a decorative lighting trim system. The Brooks patent does not suggest a safety system according to the claimed invention.

U.S. Pat. No. 5,825,280, issued on Oct. 20, 1998 to Andrew V. Merendini et al., describes a portable safety light and audible signal apparatus to guide fire fighters and emergency personnel to the exit during conditions of intense smoke and heat. The Merendini et al. patent does not suggest a safety system according to the claimed invention.

U.S. Pat. Nos. 5,833,350 and 6,000,807, issued on Nov. 10, 1998 and Dec. 14, 1999, respectively, to Gregory B. Moreland, describes a wall switch cover plate concealing an electrical circuit capable of sensing the field provided by the covered switch circuit. The Moreland patents do not suggest a safety system according to the claimed invention.

U.S. Pat. No. 6,058,635, issued on May 9, 2000 to Raymond T. Morris, describes a door frame construction with a illuminated sign units and an emergency light unit. The Morris patent does not suggest a safety system according to the claimed invention.

U.S. Pat. No. 6,222,455 B1, issued on Apr. 24, 2001 to Richard A. Kaiser, describes a smoke detector and signal device adapted for attachment to an interior door knob or to a window of a room. The Kaiser patent does not suggest a safety system according to the claimed invention.

U.S. Pat. No. 6,371,637 B1, issued on Apr. 16, 2002 to Geoffrey P. Atchinson et al., describes a low profile lighting system. The Atchinson et al. patent does not suggest a safety system according to the claimed invention.

U.S. Pat. No. 6,439,732 B1, issued on Aug. 27, 2002 to Mark A. Weisbach et al., describes a theft-proof removable door handle illumination device having a base, a door handle illumination assembly, and a case supporting the assembly. The Weisbach et al. patent does not suggest a safety system according to the claimed invention.

U.S. Pat. No. 6,454,324 B1, issued on Sep. 24, 2002 to John H. Lewis et al., describes an electronic door control and light for permitting push button and/or remote opening of a door and lighting of an area proximate the doorway. The Lewis et al. patent does not suggest a safety system according to the claimed invention.

International Patent Application Publication No. WO 83/03737, published on Oct. 27, 1983, describes a warning device that broadcasts voice commands generated by a speech synthesizer by a speaker. The International '737 application does not suggest a safety system according to the claimed invention.

European Patent Application No. 0 209 269 A2, published on Jan. 21, 1987, describes an illuminated emergency sign. The European application does not suggest a safety system according to the claimed invention.

International Patent Application No. WO 01/73733 A1, published on Oct. 4, 2001, describes an internally illuminated sign carrying element of an emergency light and sign assembly. The International '733 application does not suggest a safety system according to the claimed invention.

Japan Patent Application No. 2002-133968, published on May 10, 2002, describes an illuminated switch device having a fusion-bonded boundary surface of the illuminated knob and the actuator. The Japan application does not suggest a safety system according to the claimed invention.

None of the above inventions and patents, taken either singularly or in combination, is seen to describe the instant invention as claimed.

SUMMARY OF THE INVENTION

The present invention is a safety system that is configured to enhance the ability of individuals to identify points of egress in the case of actual fires or emergency situations. The safety system may include a power source, memory, a central processing unit (CPU), sensor(s), audible indicator(s), light source(s), switch(es) camera(s), a transceiver, a microphone, impact tool(s), and aromatic element(s). The power source may be any suitable AC or DC power source. The memory, CPU, audible indicator(s), light source(s), switch(es), camera(s), transceiver, microphone, impact tool(s), and aromatic element(s) may be any types well known in the art. The safety system may be intrinsically safe. The safety system may also include a modem configured to wirelessly or non-wirelessly transfer data to/from the safety system.

As described above, the power source may be any AC or DC power source. For example, the safety system may be configured to operate on external utility AC power or the like, and may include a port for connecting the safety system to the external AC utility power source. Alternatively, the safety system may be configured to operate on DC power, and may include one or more batteries (rechargeable or non-rechargeable) or the like, which may be removable and/or non-removable. The CPU may be connected to all of the electrical elements on the safety system, and controls the movement and process of instructions as well as data in the safety system. The memory stores instructions and data as the CPU processes information. The safety system may also include one or more sensors to detect any desirable condition, such as movement, temperature, smoke, carbon monoxide, or the like. For example, the sensor(s) may be a temperature sensor, a smoke sensor, a water level sensor, a light sensor, a contact sensor, a motion sensor, an infrared sensor, an acoustic sensor, an acceleration sensor, a hydrometer sensor, a wind-speed sensor, or the like. The sensor may communicate with the CPU by any known protocol standard. The sensor(s) may be connected to conventional circuitry that compares the level of the condition signal therefrom with a reference signal. When the condition signal level equals or exceeds the reference signal, the circuitry may output a signal, which may be either analog or digital in form, to activate any connected indicator(s).

Audible indicator may be a speaker that is powered by an amplifier to emit any distinctive audible sound, such as a buzzer, chirp, chime, or the like. Alternatively, the audible indicator may be a speaker that relays any audible communication information, such a recorded message, a relayed communication message, a relayed live transmission, or the like.

The light source(s) may be configured as a flashlight that includes a bulb and a reflector for illuminating an area. The light source(s) may be a strobe light, an incandescent light, a fluorescent light, a light emitting diode, a neon light, or the like, that periodically and/or continuously emits a bright light. The safety system may be configured to emit a light source out of a surface of the safety system. The switch may be configured to activate and deactivate the light source(s) and/or the audible indicator by any well known technique, such as depressing, rocking, rotating, or the like.

The safety system may also include one or more cameras, a transceiver, a microphone, etc. These elements may be of any type well known in the art. The camera may be a digital camera that converts a captured image into a digital bit stream for storage or transmission. The transceiver can establish two-way communication between the safety system and a telephone line by way of the antenna. The microphone may be used for relaying audio data or for activating one of the indicators on the safety system by any well known voice activation technique. The safety system may also include a modem configured to wirelessly or non-wirelessly transfer data to/from the safety system. The modem may be any type of modem, such as a chip modem, a softmodem, cellular capable modem, a wireless modem, or the like. If the safety system includes a modem, the safety system can connect to the Internet for the purpose of receiving audio and/or image data over a telephone network, such as a wireless cellular system, or the like.

The safety system may include an aromatic element to emanate a pleasant scent from the safety system, and may be a scented or aromatic material, such as basil, cinnamon, clove eucalyptus, juniper, lavender, lemon, lime, mint, orange, rose, rosemary, vanilla, or the like.

Accordingly, it is a principal aspect of the invention to provide a safety system that is configured to enhance the ability of individuals to identify points of egress in the case of actual fires or emergency situations.

It is another aspect of the invention to provide a safety system that includes a power source, memory, a CPU, sensor(s), audible indicator(s), light source(s), switch(es), camera(s), a transceiver, a microphone, aromatic element(s), and a modem.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

DETAILED DESCRIPTION OF THE PREFERRED EMBODIMENTS

Figure 1:
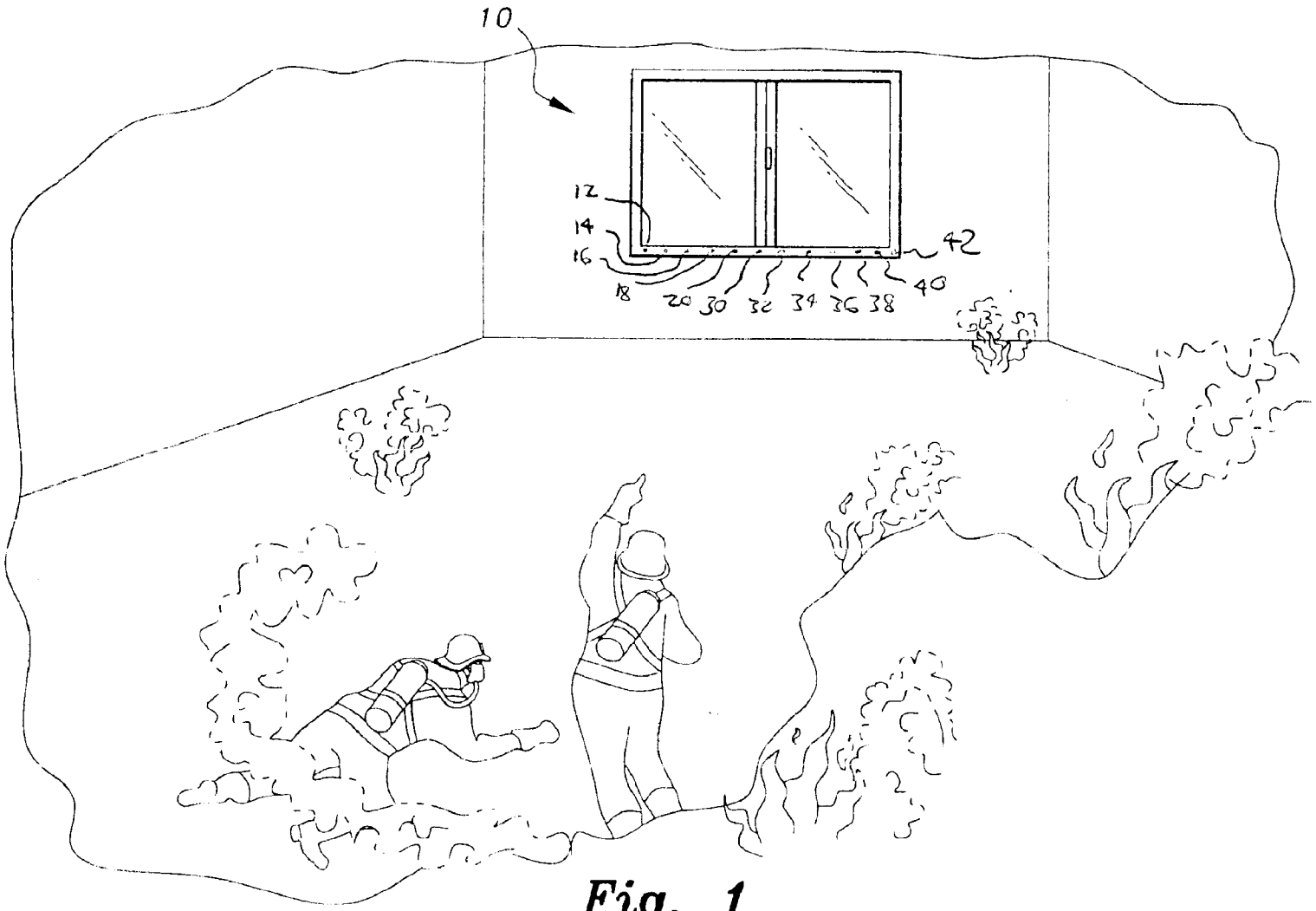
FIG. 1 is a side, perspective view of a safety system according to the present invention.

The present invention is a safety system. The invention disclosed herein is, of course, susceptible of embodiment in many different forms. Shown in the drawings and described hereinbelow in detail is are, preferred embodiments of the invention. It is to be understood, however, that the present disclosure is an exemplification of the principles of the invention and does not limit the invention to the illustrated embodiments.

Referring to the drawings, FIG. 1 illustrates firefighters using a safety system 10 according to the invention to locate an egress point out of a room engulfed in flames. Safety system 10 is configured in the form of a window frame in FIG. 1. Safety system 10 includes power source 12, memory 14, CPU 16, sensor 18, audible indicator 20, light source 30, switch 32, camera 34, transceiver 36, microphone 38, modem 40, and aromatic element 42. However, it the inventors' full intention to configure safety system 10 in any number of configurations, such as door knobs, lock fixtures, door kick plates, ceiling fan blades, ceiling fan covers, or the like. Safety system 10 may also be configured in the form of molding or trim for windows, walls, or the like. Safety system 10 may also be built into or incorporated into any existing structure, such as doors, window frames, ceiling fan blades, ceiling fan covers, or the like. Safety system 10 may be made from any desirable durable material, such as such as metal, wood, or the like. The material used for safety system 10 may be opaque or translucent and may be colored according to the desires of the user. For example, safety system 10 may be brightly, fluorescently colored to make it easy to identify work areas, points of egress, or to lead a trail to and from search areas.

Figure 2:
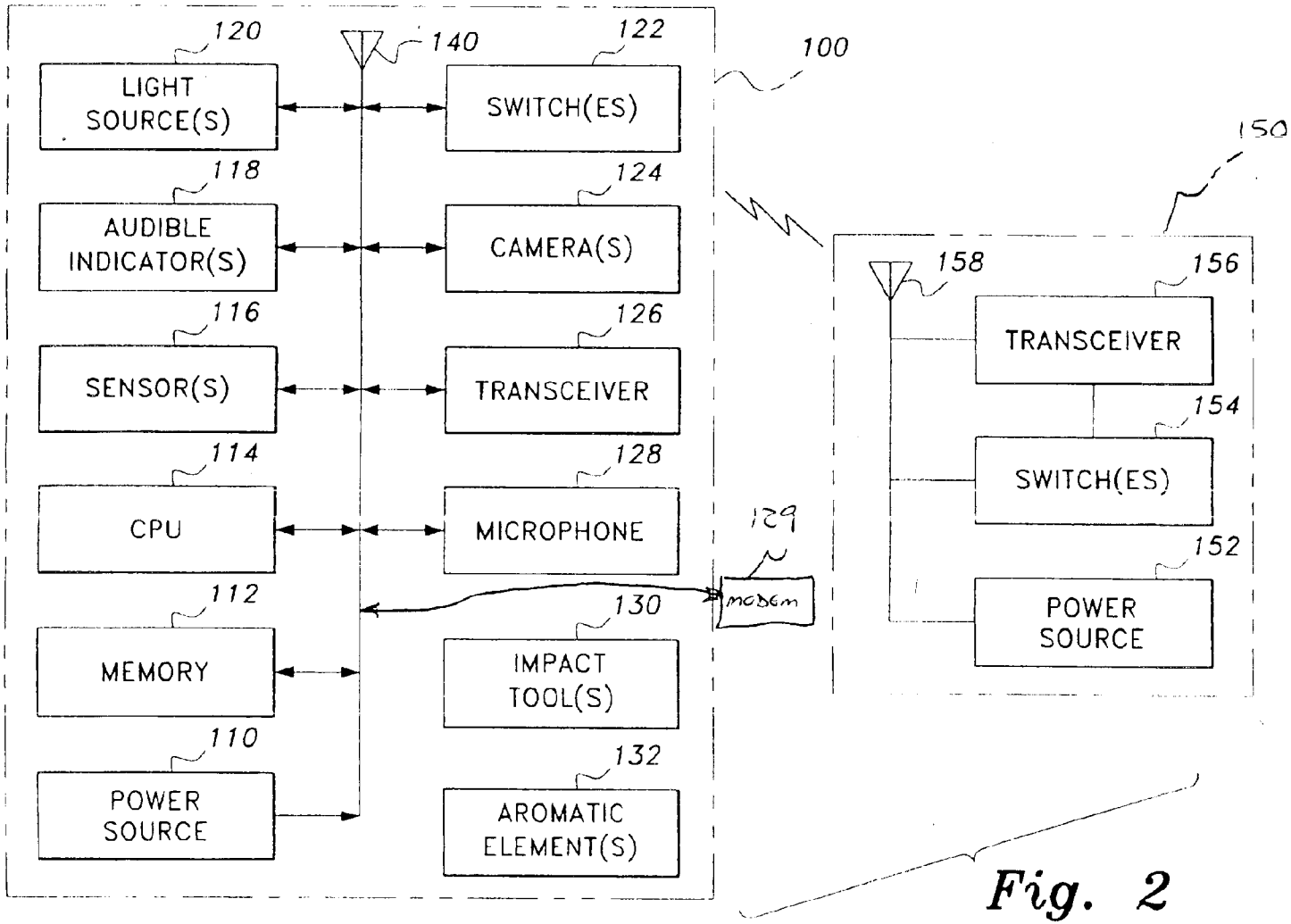
FIG. 2 is a block diagram of a safety system according to the present invention.

As shown in FIG. 2, safety system 100 may include power source 110, memory 112, CPU 114, sensor(s) 116, audible indicator(s) 118, light source(s) 120, switch(es) 122, camera(s) 124, transceiver 126, microphone 128, modem 129, impact tool(s) 130, and aromatic element(s) 132. Power source 110 may be any suitable AC or DC power source. Memory 112, CPU 114, audible indicator(s) 118, light source(s) 120, switch(es) 122, camera(s) 124, transceiver 126, microphone 128, impact tool(s) 130, and aromatic element(s) 132 may be any types well known in the art. Safety system 100 may also include a modem (not shown) configured to wirelessly or non-wirelessly transfer data to/from safety system 100.

A remote device 150 is shown in FIG. 2 that includes a power source 152, switch(es) 154, transceiver 156, and antenna 158. The remote device 150 is configured to enable a user to remotely activate any or all of the safety system 100 elements through the use of switch(es) 154, and wireless communication via transceivers 156 and 126 (e.g. sensor(s) 116, audible indicator(s) 118, light source(s) 120, switch(es) 122, and camera(s) 124, transceiver 126).

Figure 3:
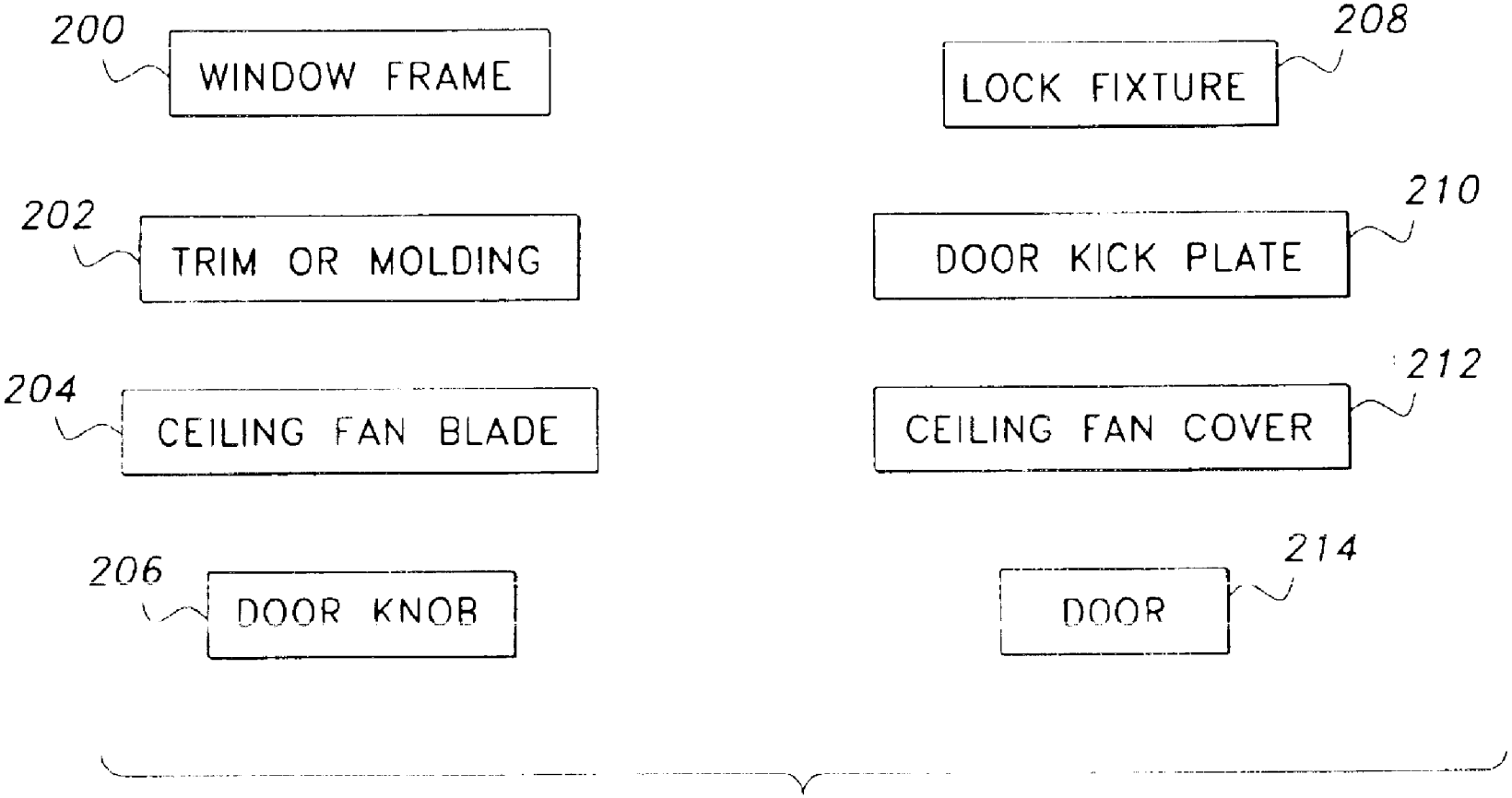
FIG. 3 is shows a window frame, trim or molding, a ceiling fan blade, a door knob, a lock fixture, a door kick plate, a ceiling fan cover, and a door according to the present invention.

FIG. 3 is shows a window frame 200, trim or molding 202, a ceiling fan blade 204, a door knob 206, a lock fixture 208, a door kick plate 210, a ceiling fan cover 212, and a door 214 according to the present invention.

As described above, power source 110 may be any AC or DC power source. For example, safety 100 may be configured to operate on external utility AC power or the like, and may include a port for connecting safety system 100 to the external AC utility power source. Alternatively, safety system 100 may be configured to operate on DC power, and may include one or more batteries (rechargeable or non-rechargeable) or the like, which may be removable and/or non-removable. CPU 114 may be connected to all of the electrical elements on safety system 100, and controls the movement and process of instructions as well as data in safety system 100. Memory 112 stores instructions and data as CPU 114 processes information. Safety system 100 may also include one or more sensors 116 to detect any desirable condition, such as movement, temperature, smoke, carbon monoxide, or the like. For example, the sensor(s) 116 may be a temperature sensor, a smoke sensor, a water level sensor, a light sensor, a contact sensor, a motion sensor, an infrared sensor, an acoustic sensor, an acceleration sensor, a hydrometer sensor, a wind-speed sensor, or the like. The sensor(s) 116 may communicate with the CPU 114 by any known protocol standard. The sensor(s) 116 may be connected to conventional circuitry that compares the level of the condition signal therefrom with a reference signal. When the condition signal level equals or exceeds the reference signal, the circuitry may output a signal, which may be either analog or digital in form, to activate any connected indicator(s) 118.

Audible indicator 118 may be a speaker that is powered by an amplifier to emit any distinctive audible sound, such as a buzzer, chirp, chime, or the like. Alternatively, audible indicator 118 may be a speaker that relays any audible communication information, such a recorded message, a relayed communication message, a relayed live transmission, or the like.

Light source(s) 120 may be configured as a flashlight that includes a bulb and a reflector for illuminating an area. Light source(s) 120 may be a strobe light, an incandescent light, a fluorescent light, a light emitting diode, a neon light, or the like, that periodically and/or continuously emits a bright light. Safety system 100 may be configured to emit light source(s) 120 out of a surface of the safety system 100. Switch 122 may be configured to activate and deactivate light source(s) 120 and/or audible indicator 118 by any well known technique, such as depressing, rocking, rotating, or the like.

Safety system 100 may also include one or more camera(s) 124, a transceiver 126, a microphone 128, etc. These elements may be of any type well known in the art. The camera(s) 124 may be a digital camera that converts a captured image into a digital bit stream for storage or transmission. The transceiver 126 can establish two-way communication between safety system 100 and a telephone line by way of antenna 140. The microphone 128 may be used for relaying audio data or for activating one of the indicators on safety system 10 by any well known voice activation technique. Safety system 10 may also include a modem (not shown) configured to wirelessly or non-wirelessly transfer data to/from safety system 100. The modem may be any type of modem, such as a chip modem, a softmodem, cellular capable modem, a wireless modem, or the like. If safety system 100 includes a modem, safety system 100 can connect to the Internet for the purpose of receiving audio and/or image data over a telephone network, such as a wireless cellular system, or the like.

Safety system 100 may include an aromatic element 132 to emanate a pleasant scent from safety system 100, and may be a scented or aromatic material, such as basil, cinnamon, clove eucalyptus, juniper, lavender, lemon, lime, mint, orange, rose, rosemary, vanilla, or the like.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

We claim:

1. A window frame safety system comprising:

a window frame including at least one sensor, at least one signaling device, a microphone, and a power source, said window frame being configured to enhance an ability of individuals to identify points of egress in a case of actual fires or emergency situations, wherein said at least one signaling device is configured to emit at least one of an audible signal and a visual signal.

2. The safety system according to claim 1, wherein said at least one signaling device includes a light source.

3. The safety system according to claim 2, wherein said light source is a flashlight.

4. The safety system according to claim 2, wherein said light source is a strobe light.

5. The safety system according to claim 1, wherein said at least one signaling device includes an audible indicator.

6. The safety system according to claim 1, further comprising memory and a central processing unit.

7. The safety system according to claim 1, further comprising at least one switch.

8. The safety system according to claim 1, further comprising at least one camera.

9. The safety system according to claim 8, wherein said camera is a digital camera.

10. The safety system according to claim 1, further comprising a transceiver.

11. The safety system according to claim 1, further being communicatively interconnected with the Internet.

12. The safety system according to claim 1, further comprising at least one aromatic element.

13. The safety system according to claim 12, wherein said at least one aromatic element is selected from the group consisting of basil, cinnamon, clove eucalyptus, juniper, lavender, lemon, lime, mint, orange, rose, rosemary, and vanilla.

14. A trim or molding safety system comprising:

trim or molding including at least one sensor configured to sense a predetermined condition, at least one signaling device configured to activate upon sensing of the predetermined condition by the at least one signaling device, a microphone, and a power source electrically interconnected to one another, said trim or molding being configured to enhance an ability of individuals to identify points of egress in a case of actual fires or emergency situations, wherein said at least one signaling device is configured to emit at least one of an audible signal and a visual signal.

15. The trim or molding safety system according to claim 14, further comprising a light source, an audible indicator, a central processing unit, a switch, a camera, and an aromatic element, said trim or molding being communicatively interconnectable with the Internet.

16. A ceiling fan blade safety system comprising:

a ceiling fan blade including at least one sensor, at least one signaling device, and a power source, said ceiling fan blade being configured to enhance an ability of individuals to identify points of egress in a case of actual fires or emergency situations, wherein said at least one signaling device is configured to emit at least one of an audible signal and a visual signal.

17. The ceiling fan blade safety system according to claim 16, further comprising a light source, an audible indicator, a central processing unit, a switch, a camera, a microphone, a modem, and an aromatic element, said ceiling fan blade being communicatively interconnectable with the Internet.

18. A door knob safety system comprising:

a door knob including at least one sensor, at least one signaling device, a microphone, and a power source, said door knob being configured to enhance an ability of individuals to identify points of egress in a case of actual fires or emergency situations, wherein said at least one signaling device is configured to emit at least one of an audible signal and a visual signal.

19. The door knob safety system according to claim 18, further comprising a light source, an audible indicator, a central processing unit, a switch, a camera, a modem, and an aromatic element, said door knob being communicatively interconnectable with the Internet.

20. A lock fixture safety system comprising:

a lock fixture including at least one sensor, at least one signaling device, a microphone, and a power source, said lock fixture being configured to enhance an ability of individuals to identify points of egress in a case of actual fires or emergency situations, wherein said at least one signaling device is configured to emit at least one of an audible signal and a visual signal.

21. The lock fixture safety system according to claim 20, further comprising a light source, an audible indicator, a central processing unit, a switch, a camera, a modem, and an aromatic element, said lock fixture being communicatively interconnectable with the Internet.

22. A door kick plate safety system comprising:

a door kick plate including at least one sensor, at least one signaling device, a microphone, and a power source electrically interconnected to one another, said door kick plate being configured to enhance an ability of individuals to identify points of egress in a case of actual fires or emergency situations, wherein said at least one signaling device is configured to emit at least one of an audible signal and a visual signal.

23. The door kick plate safety system according to claim 22, further comprising a light source, an audible indicator, a central processing unit, a switch, a camera, a modem, or an aromatic element, said door kick plate being communicatively interconnectable with the Internet.

24. A ceiling fan cover safety system comprising:

a ceiling fan cover including at least one sensor, at least one signaling device, and a power source, said ceiling fan cover being configured to enhance an ability of individuals to identify points of egress in a case of actual fires or emergency situations, wherein said at least one signaling device is configured to emit at least one of an audible signal and a visual signal.

25. The ceiling fan cover safety system according to claim 24, further comprising a light source, an audible indicator, a central processing unit, a switch, a camera, a microphone, a modem, and an aromatic element, said ceiling fan cover being communicatively interconnectable with the Internet.

26. A door safety system comprising:

a door including at least one sensor, at least one signaling device, a microphone, and a power source electrically interconnected to each other, said door being configured to enhance an ability of individuals to identify points of egress in a case of actual fires or emergency situations, wherein said at least one signaling device is configured to emit at least one of an audible signal and a visual signal.

27. The door safety system according to claim 26, further comprising a light source, an audible indicator, a central processing unit, a switch, a camera, a modem, and an aromatic element, said door being communicatively interconnectable with the Internet.

* * * * *